US007891982B2

(12) United States Patent
Lin et al.

(10) Patent No.: US 7,891,982 B2
(45) Date of Patent: Feb. 22, 2011

(54) ELECTRICAL CONNECTOR HAVING WIRE TYPE CONTACTS

(75) Inventors: Nan-Hung Lin, Tu-cheng (TW); Fu-Pin Hsieh, Tu-cheng (TW)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 142 days.

(21) Appl. No.: 12/287,908

(22) Filed: Oct. 14, 2008

(65) Prior Publication Data

US 2009/0098753 A1 Apr. 16, 2009

(30) Foreign Application Priority Data

Oct. 12, 2007 (CN) ..... 2007 2 0043635 U

(51) Int. Cl.
*H01R 9/09* (2006.01)

(52) U.S. Cl. ..... 439/66

(58) Field of Classification Search ..... 439/66, 439/71, 65, 91; 257/697, 700, 698
See application file for complete search history.

(56) References Cited

U.S. PATENT DOCUMENTS

| | | | | |
|---|---|---|---|---|
| 6,174,172 | B1 * | 1/2001 | Kazama | 439/66 |
| 6,846,184 | B2 * | 1/2005 | Fan et al. | 439/66 |
| 2006/0211276 | A1 * | 9/2006 | Li | 439/66 |

* cited by examiner

*Primary Examiner*—Alexander Gilman
(74) *Attorney, Agent, or Firm*—Andrew C. Cheng; Wei Te Chung; Ming Chieh Chang

(57) ABSTRACT

An electrical connector (100) for electrically connecting an electronic package with a circuit substrate comprises an insulative housing (1) and a plurality of contacts (2) insert-molded on the insulative housing (1), the insulative housing (1) comprises a bottom surface (12) and an upper surface (11) opposite to the bottom surface (12), the contact (2) comprises a retaining portion (23), a first contact portion (21) extending upwardly beyond the upper surface (11) for connecting with the electronic package and a second contact portion (22) extending downwardly beyond the bottom surface (12) for connecting with the circuit substrate, the second contact portion (22) with spire shape formed a receiving space (221). Thus, the second contact portion (22) can connect with the circuit substrate by directly or indirectly style.

16 Claims, 3 Drawing Sheets

ELECTRICAL CONNECTOR HAVING WIRE TYPE CONTACTS

BACKGROUND OF THE INVENTION

1. Field of the Invention

The present invention relates to an electrical connector and particularly to an electrical connector for electrically connecting electronic packages, such as Land Grid Array (LGA) Central Processing Units (CPU), with circuit substrate, such as printed circuit boards (PCB).

2. Description of the Prior Art

With the development of the science and technology, for the demanding of convenience use, we always use a socket to electrically connecting a Central Processing Units (CPU), with a circuit substrate, such as printed circuit board (PCB). The conventional socket for electrically connecting a CPU with a PCB approximately being divided to three types according to the contacting style of the contacts: LGA (Land Grid Array) type, BGA (Ball Grid Array) type and PGA (Pin Grid Array) type. The contacts are usually assembled in the insulative, but with the smaller development of the socket, the contacts are also became smaller and smaller. So, it is harder to assemble the contacts and the contacts are easy to distortion, which impact the contacting quality of the socket. In addition, the BGA type contacts are usually connected to the PCB via the solder balls, the solder balls are solded to the contacts, thus increased the cost of the socket. The same time, this type contacts must be solded to the solder balls to connect to the PCB, it can not meet the different using demanding, for example, to use as a LGA type contact.

In view of the above, a new electrical connector which overcomes the above-mentioned disadvantages is desired.

SUMMARY OF THE INVENTION

Accordingly, an object of the present invention is to provide an electrical connector which comprises wire contacts received in the insulative housing with insert molding mode and connected with the circuit substrate directly or indirectly.

To achieve the above-mentioned object, an electrical connector assembly in accordance with a preferred embodiment of the present invention, comprises an insulative housing and a plurality of contacts insert-molded on the insulative housing, the insulative housing comprises a bottom surface for being assembled to the circuit substrate and an upper surface opposite to the bottom surface for supporting the electronic package, the contact comprises a retaining portion, a first contact portion extending upwardly beyond the upper surface for electrically connecting with the electronic package and a second contact portion extending downwardly beyond the bottom surface for electrically connecting with the circuit substrate, the second contact portion with spire shape formed a receiving space.

Other objects, advantages and novel features of the invention will become more apparent from the following detailed description when taken in conjunction with the accompanying drawings, in which:

DETAILED DESCRIPTION OF THE PREFERRED EMBODIMENT OF THE INVENTION

Reference will now be made to the drawings to describe the present invention in detail.

Figure 1:
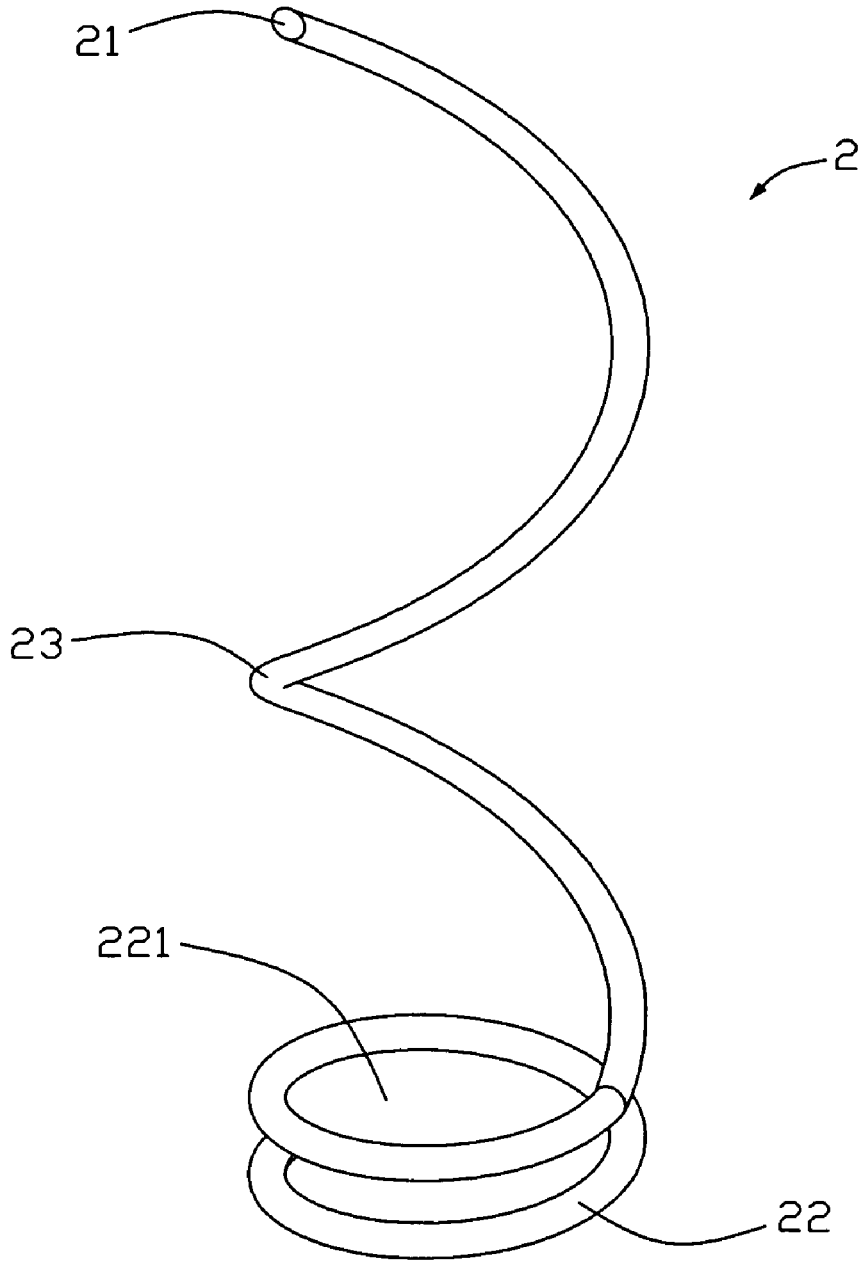
FIG. 1 is an isometric view of a contact of an electrical connector in accordance with the embodiment of the present invention.
Figure 2:
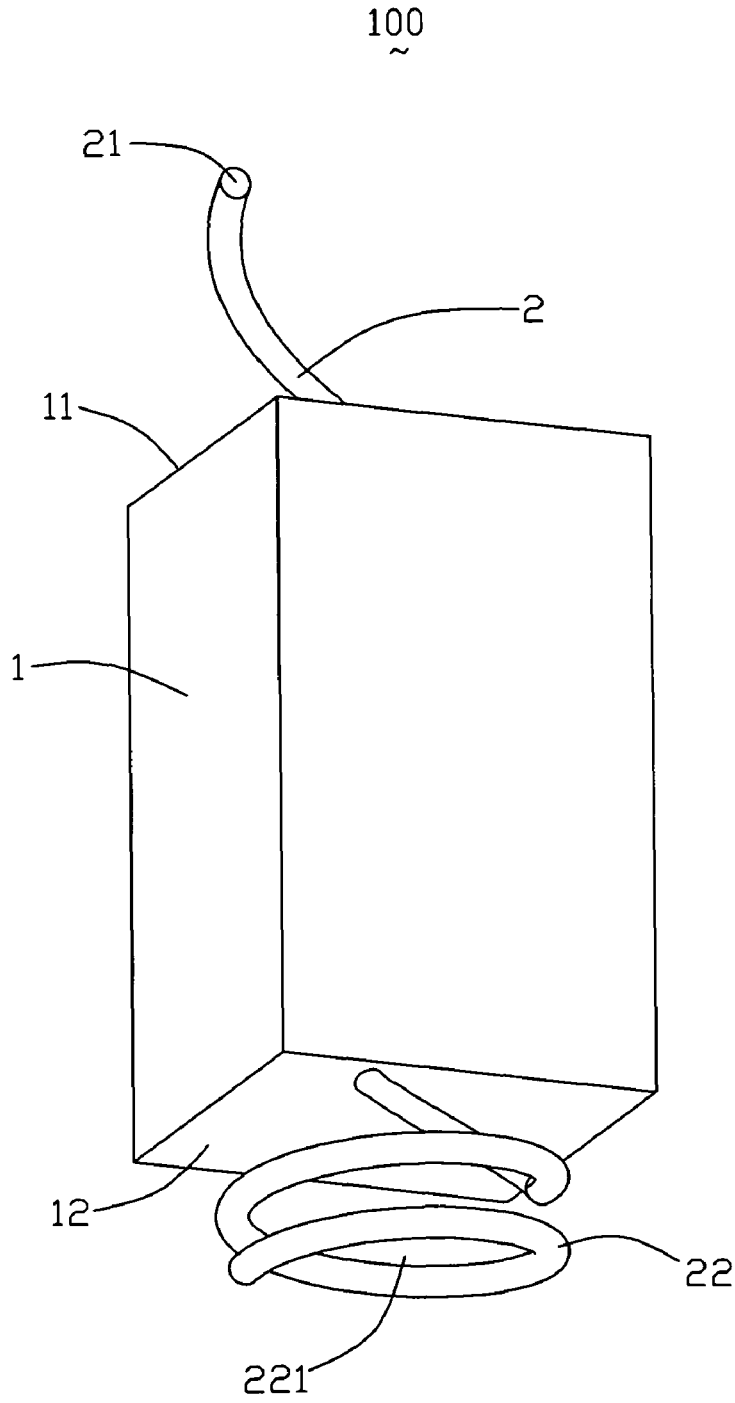
FIG. 2 is an assembled view of an electrical connector in accordance with the embodiment of the present invention, only showing one section of the insulative housing and one contact received in the insulative housing.

Referring to FIGS. 1-2, an electrical connector 100 in accordance with the present invention is used for electrically connecting an electronic package (not showing) with a circuit substrate (not showing) and comprises an insulative housing 1 and a plurality of contacts 2 received therein. For simplification, only one section of the whole insulative housing 1 and one contact 2 is shown.

The insulative housing 1 with a rectangular shape comprises a flat bottom surface 12 for being assembled to the circuit substrate and an upper surface 11 opposite to the bottom surface 12 for supporting the electronic package.

The contact 2 is made of metal wire and comprises a retaining portion 23, a first contact portion 21 extending upwardly beyond the upper surface 11 of the insulative housing 1 for electrically connecting with the electronic package and a second contact portion 22 extending downwardly beyond the bottom surface 12 of the insulative housing 1 for electrically connecting with the circuit substrate. The first contact portion 21 and the retaining portion 23 are curves and together form a spiral shape. The second contact portion 22 with spiral shape is formed with two circular portion and comprises a receiving space 221.

Referring to FIG. 2, the contact 2 is assembled in the insulative housing 1 with an insert molding mode, and the second contact portion 22 is directly connected with the circuit substrate. Thus, the electrical connector 100 is connected with the circuit substrate with LGA style.

Figure 3:
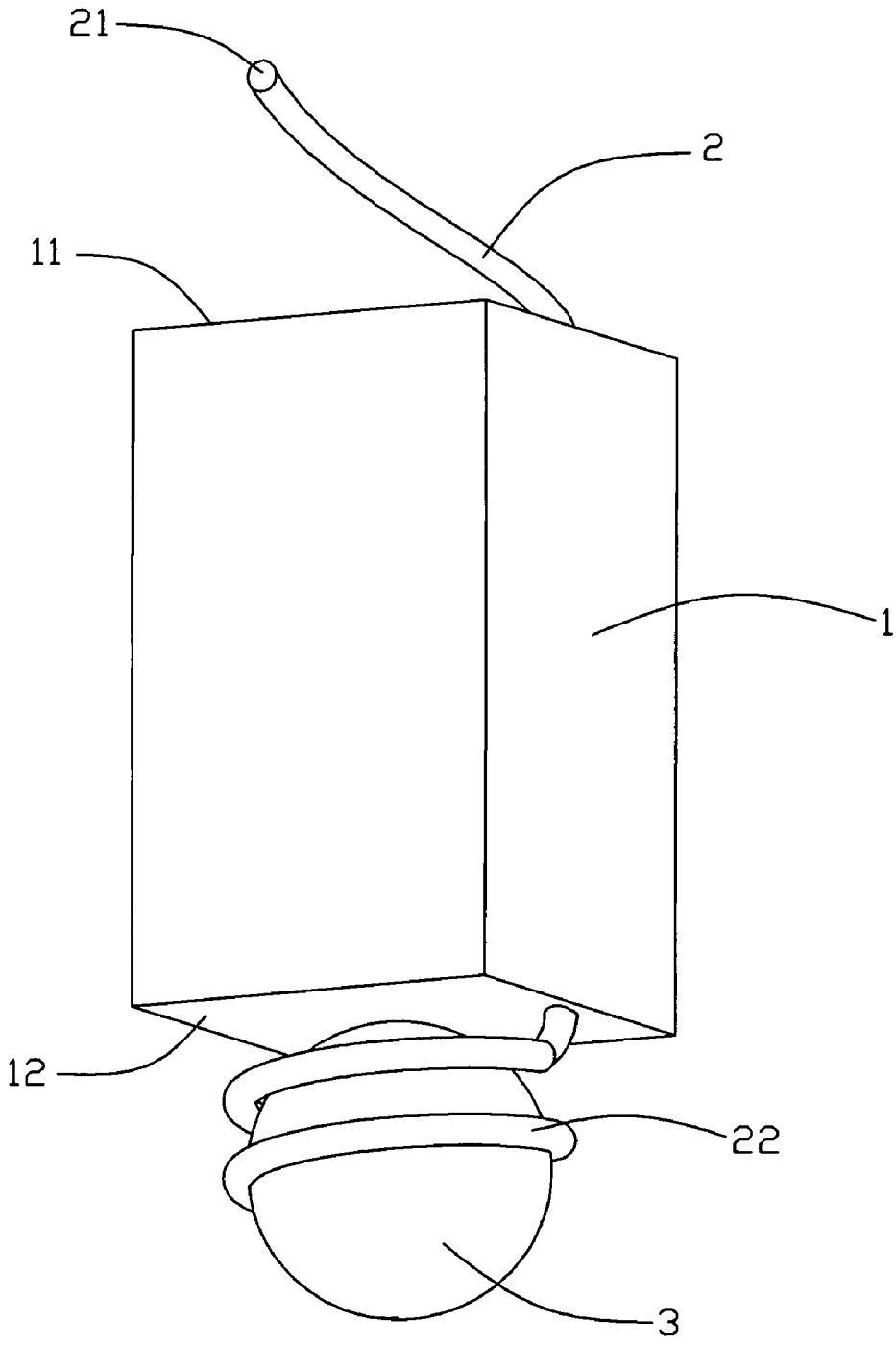
FIG. 3 is an assembled view of a solder ball with the electrical connector of FIG. 2.

Referring to FIG. 3, the second contact portion 22 is connected with the circuit substrate via a solder ball 3. The solder ball 3 is retained in the receiving space 221 of the second contact portion 22 by the two circular portion of the contact 2, the second contact portion 22 is indirectly connected with the circuit substrate via solder balls 3. Thus, the electrical connector 100 is connected with the circuit substrate with BGA style.

While preferred embodiment in accordance with the present invention has been shown and described, equivalent modifications and changes known to persons skilled in the art according to the spirit of the present invention are considered within the scope of the present invention as defined in the appended claims.

What is claimed is:

1. An electrical connector for electrically connecting an electronic package with a circuit substrate comprising:

an insulative housing comprising a bottom surface for being assembled to the circuit substrate and an upper surface opposite to the bottom surface for supporting the electronic package; and a plurality of contacts insert-molded on the insulative housing, and comprising a retaining portion, a first contact portion extending upwardly beyond the upper surface for electrically connecting with the electronic package and a second contact portion extending downwardly beyond the bottom surface for electrically connecting with the circuit substrate, the second contact portion with spiral shape formed a receiving space thereby securing a solder ball therein before the connector mounted onto the circuit substrate.

2. The electrical connector as claimed in claim 1, wherein the contacts are made of metal wire.

3. The electrical connector as claimed in claim 2, wherein the first contact portion and the retaining portion are curves and together form a spiral shape.

4. The electrical connector as claimed in claim 2, wherein the second contact portion is formed with two circular portions.

5. An electrical connector comprising an insulative housing with a plurality of contacts embedded therein, each of said contacts made from a wire and including a resilient contact arm with an upper end extending above an upper face of the housing for engagement with an electronic package having circuit pads thereon, and a discrete solder section exposed below a bottom face of the housing, wherein the solder section grasps a solder ball therewith and the solder ball moves with the deformation of the solder section.

6. The electrical connector as claimed in claim 5, wherein said contacts are insert-molded with the housing.

7. The electrical connector as claimed in claim 5, wherein the solder section is wound to grasp the solder ball.

8. The electrical connector as claimed in claim 5, wherein each of said contacts defines a retaining section in a deflected manner for efficiently held by the housing.

9. The electrical connector as claimed in claim 5, wherein the solder section is in form of helix.

10. The electrical connector as claimed in claim 9, wherein said helix is a conical helix rather than a cylindrical helix.

11. The electrical connector as claimed in claim 5, wherein said solder ball is essentially exposed to an exterior in a direction opposite to said housing for mounting to a printed circuit board.

12. An electrical connector comprising an insulative housing with a plurality of contacts embedded therein, each of said contacts including a resilient contact arm with an upper end extending above an upper face of the housing for engagement with an electronic package having circuit pads thereon, and a discrete solder section exposed below a bottom face of the housing, wherein the solder section grasps a solder ball therewith and the solder ball moves with the contact synchronically under a condition that said solder section is in form of helix.

13. The electrical connector as claimed in claim 12, wherein said contacts are insert-molded with the housing.

14. The electrical connector as claimed in claim 12, wherein said solder ball is fully exposed below the bottom surface of the housing.

15. The electrical connector as claimed in claim 12, wherein each of the contacts is wholly in form of helix under a condition that a pitch of the helix in the solder section is smaller than that in any other portions.

16. The electrical connector as claimed in claim 12, wherein said solder ball is essentially exposed to an exterior in a direction opposite to said housing for mounting to a printed circuit board.

* * * * *